US009032966B2

(12) United States Patent
Geraths

(10) Patent No.: US 9,032,966 B2
(45) Date of Patent: May 19, 2015

(54) SMOKE BOX WITH INTEGRAL CONVERSION TO LARGER-BOWL SMOKING PIPE

(75) Inventor: William Charles Geraths, Cazenovia, WI (US)

(73) Assignee: William Geraths, Cazenovia, WI (US)

( * ) Notice: Subject to any disclaimer, the term of this patent is extended or adjusted under 35 U.S.C. 154(b) by 639 days.

(21) Appl. No.: 13/437,831

(22) Filed: Apr. 2, 2012

(65) Prior Publication Data

US 2013/0255700 A1 Oct. 3, 2013

(51) Int. Cl.
*A24F 23/04* (2006.01)
*A24F 1/00* (2006.01)

(52) U.S. Cl.
CPC .. *A24F 1/00* (2013.01); *A24F 23/04* (2013.01)

(58) Field of Classification Search
CPC ..... A24F 23/04
See application file for complete search history.

(56) References Cited

U.S. PATENT DOCUMENTS

| | | | | |
|---|---|---|---|---|
| 4,214,658 | A | 7/1980 | Crow | |
| 5,832,953 | A * | 11/1998 | Lattner et al. | 137/315.08 |
| 5,967,312 | A * | 10/1999 | Jacobs | 206/266 |
| 6,474,342 | B1 * | 11/2002 | Rennecamp | 131/241 |
| 8,584,842 | B2 * | 11/2013 | Fakhouri et al. | 206/236 |

* cited by examiner

*Primary Examiner* — Michael J Felton

(57) ABSTRACT

A smoke box is provided to hold smoking material, a smoking pipe, and a smoking bowl. The smoking pipe holds a small quantity of smoking material. The smoking bowl holds a more substantial quantity of smoking material. The small smoking pipe, when inserted into the side-cavity on the smoke box, becomes a mouthpiece and a filtering chamber for the smoking material to be smoked through the smoking bowl, thereby providing two choices for the amount of smoking material for smoking.

5 Claims, 6 Drawing Sheets

SMOKE BOX WITH INTEGRAL CONVERSION TO LARGER-BOWL SMOKING PIPE

CROSS REFERENCE TO RELATED APPLICATIONS

N/A

FEDERALLY SPONSORED RESEARCH

N/A

JOINT RESEARCH AGREEMENT

N/A

REFERENCE TO A SEQUENCE LISTING

N/A

BACKGROUND OF THE INVENTION

1. Field of Invention

This invention relates to a smoke box and more particularly, to a smoke box to hold a smoking pipe, and smoking material, and to also convert the smoke box itself into a smoking pipe with a bowl portion with means to smoke a generous quantity in one compact container.

2. Description of Prior Art

Present day smoke boxes designed to hold a pipe and smoking material with which to fill the pipe lack means to smoke a generous quantity in smooth succession. In 1980, U.S. Pat. No. 4,214,658 was issued to Floyd Crow in which a receptacle has two cavities to hold a smoking pipe and smoking material in a compact container. The present invention differs from Crow's in that in Crow's patent there is no option to convert the smoke box itself into a smoking pipe. Further, these smoke boxes frequently bear a cover which is not fastened to the principal container, lending to the likelihood that the cover become lost or become incompatible with the principal container due to natural shrinkage and expansion of container material. Thus, there is a need for a smoke box with a fastened cover with means to smoke a generous quantity of smoking material.

Accordingly, a primary object of the present invention is to provide an improved smoke box which consists of a compact receptacle for holding a pipe, a chamber for holding smoking material, and a bowl portion that provides for smoking a more generous quantity as the smoke box converts into a smoking pipe itself.

Another object of my invention is to provide a smoke box which bears covers fastened to the principal container.

In the preferred embodiment of my invention, a pipe is held in a circular-shaped cavity and smoking material is stored in a second cavity. A third semi-circle shaped cavity functions as an integral more-generous bowl and a fourth cavity retains the pipe when the smoke box is converted into a smoking pipe in itself. Fasteners on both ends of the container prevent the covers from being lost or becoming incompatible with the principal container.

BRIEF SUMMARY OF THE INVENTION

A smoke box holds a pipe, provides a storage space for the smoking material, and includes an integral bowl portion which can accommodate more smoking material than can the pipe. The smoke box in itself can be converted into a larger pipe when the pipe is inserted into the side of the smoke box and the integral, more-generous bowl is filled with smoking material and smoked.

DETAILED DESCRIPTION OF THE INVENTION

Figure 1:
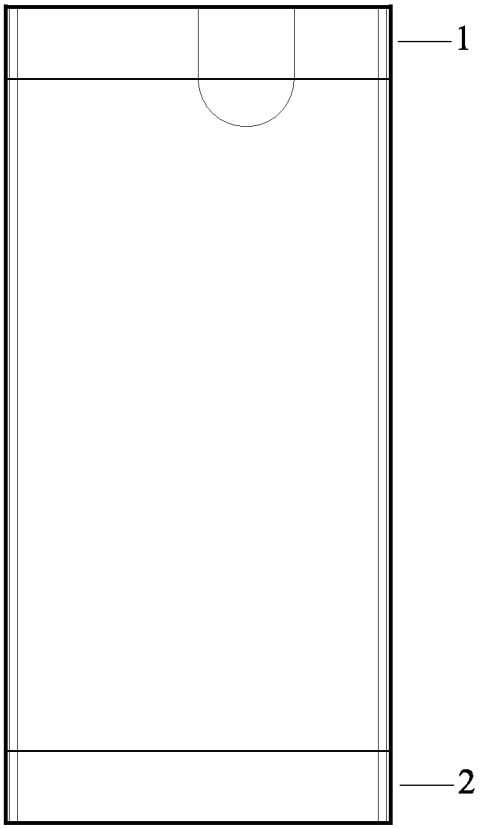
FIG. 1 is an elevation view of the front of the disclosed invention.
Figure 2:
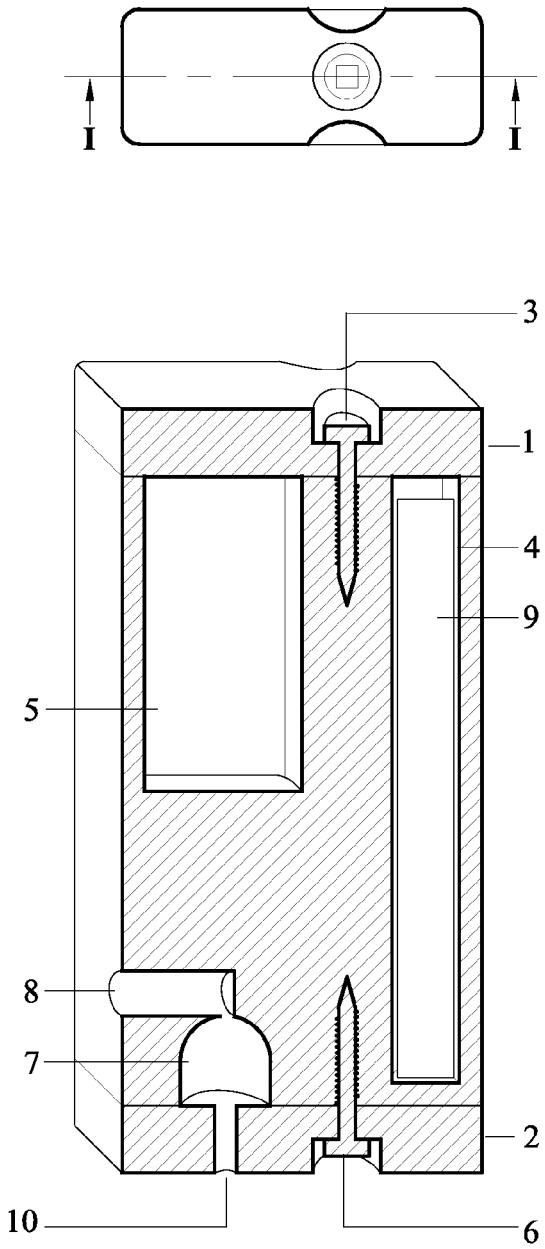
FIG. 2 is a cross-sectional view of the inventive smoke box along line I.

As shown in FIG. 1, a smoke box constructed in accordance with my invention comprises a smoke box with top cover 1 and bottom cover 2 thereon. As shown in FIG. 2, top cover 1 is secured with fastener 3 and opens and closes over smoking pipe cavity 4 and smoking material cavity 5. Fastener 6 secures bottom cover 2 over bowl cavity 7. Side cavity 8 is shaped to receive smoking pipe 9. Smoking material is inserted into cavity 7 and ignited through small hole 10.

Figure 3:
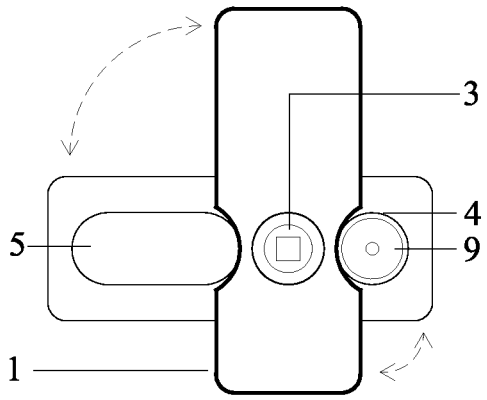
FIG. 3 is a plan view of the inventive smoke box with the top cover open.
Figure 4:
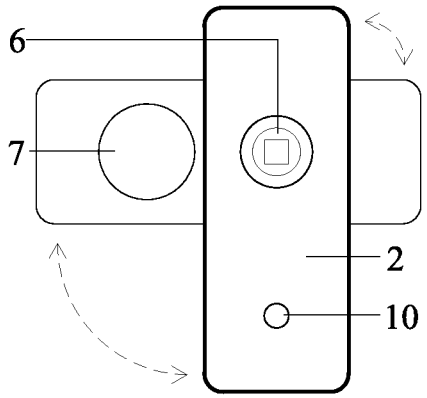
FIG. 4 is a plan view of the inventive smoke box with the bottom cover open.

As can be seen in FIG. 3 top cover 1 rotates on fastener 3 clockwise to expose pipe cavity 4 with smoking pipe 9, and smoking material cavity 5. As can be seen in FIG. 4 bottom cover 2 rotates on fastener 6 counter-clockwise to expose bowl cavity 7. With bottom cover 2 in place, material is burned through small hole 10.

Figure 5:
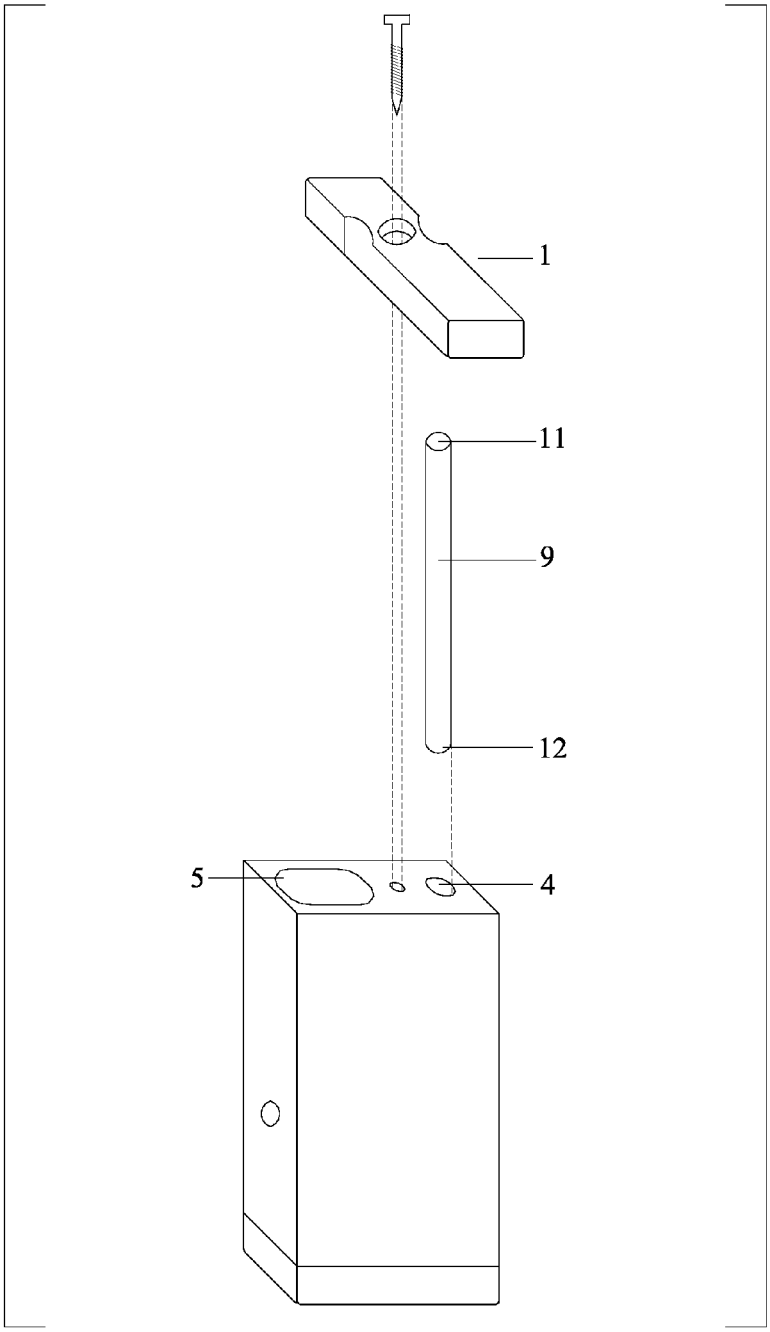
FIG. 5 is an exploded isometric view of the inventive smoke box.

The operation of the unique smoke box is as follows:

As shown in FIG. 5 smoking pipe 9 is easily removed from pipe cavity 4 by opening top cover 1 and tipping smoke box on side and grasping mouthpiece 11 with fingers. Smoking pipe bowl 12 of smoking pipe 9 is pressed into material in cavity 5 and is moved up and down until filled with smoking material. A sharp edge is provided on edges of smoking pipe bowl 12 to cut away excess smoking material when pushed against smoking material. The smoking pipe bowl 12 can be lighted and smoked. Smoker inhales smoke using mouthpiece 11.

Figure 6:
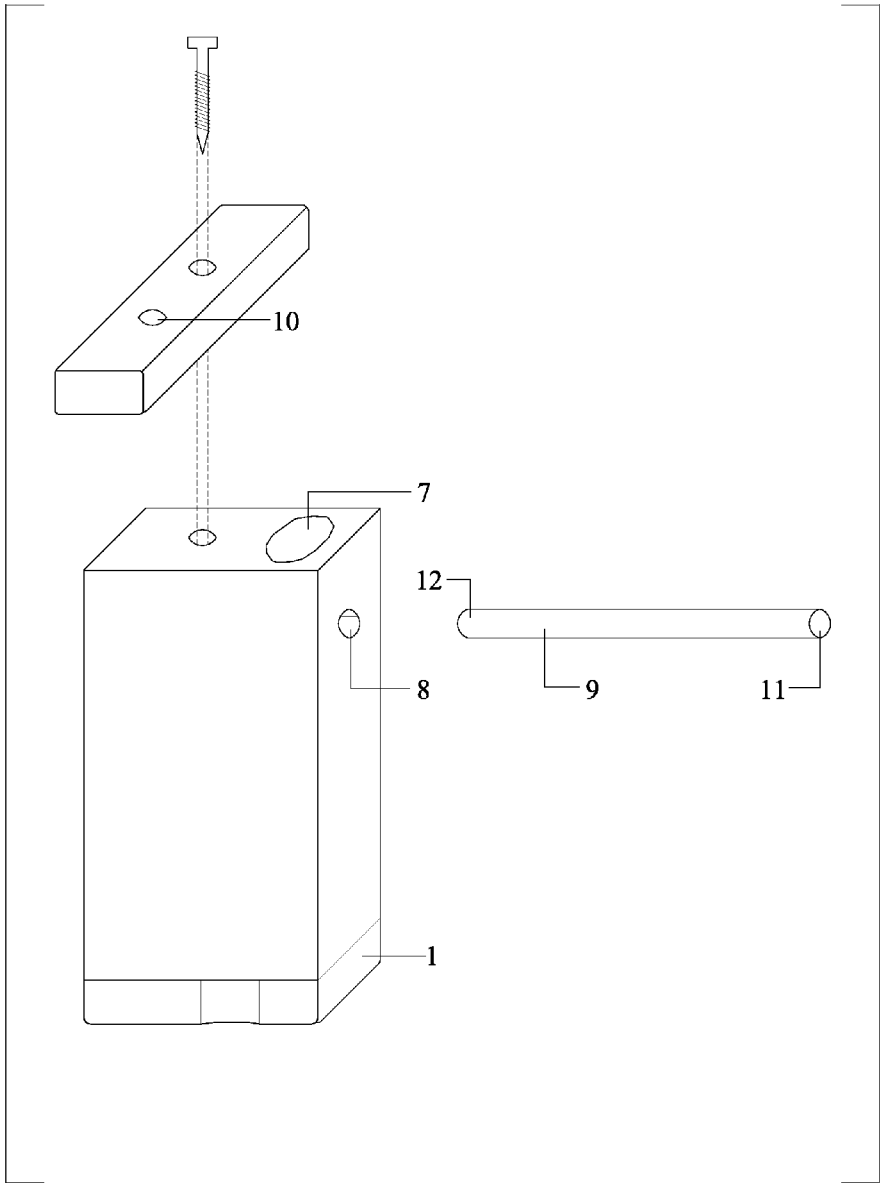
FIG. 6 is an up-side-down exploded isometric view of the inventive smoke box showing how pipe inserted into side cavity.

As shown in FIG. 6 smoke box is turned up-side-down and smoking pipe bowl 12 is inserted into side cavity 8 with contact pressure. User can light material in bowl cavity 7 through small hole 10, smoke is pulled through side cavity 8 and then through mouthpiece 11 to the smoker. Pipe 9 can then be removed from side cavity 8 and stored in cavity 4, with top cover 1 in closed position.

It is apparent therefore, that the present invention provides a simple and compact smoke box to hold a pipe, smoking material, and a larger smoking bowl to provide two choices for the amount for smoking.

While the principles of the invention have been described above in connection with a specific embodiment and applications, it is to be understood that this description is made only by way of example and not as a limitation on the scope of the invention.

I claim:

1. A smoke box comprising:

a. a cylindrical cavity covered by a top cover;

b. a small smoking pipe is stored within the cylindrical cavity, one end having a mouthpiece and one end a small smoking bowl, c. a second cavity, shorter than said cylindrical cavity, wherein smoking material is disposed, covered by said top cover;

d. a bowl-shaped cavity wherein more smoking material can be stored and smoked than in said small smoking pipe, covered by a bottom cover that opens and closes over said bowl-shaped cavity;

e. a cylindrical opening on the side of the box in fluid communication with said bowl-shaped cavity wherein said cylindrical opening is adapted to receive the small smoking bowl of the small smoking pipe.

2. The smoke box of claim 1 wherein said top cover is fastened by a fastener between said cylindrical cavity and said second cavity.

3. The smoke box of claim 2 wherein said top cover, includes a recess formed on either side of said fastener.

4. The smoke box of claim 1 wherein said bottom cover is fastened between said bowl-shaped cavity and the thick base.

5. The smoke box of claim 1 wherein said bottom cover has small circular opening into said bowl-shaped cavity.

* * * * *